US012736235B2

(12) United States Patent
Ahn

(10) Patent No.: US 12,736,235 B2
(45) Date of Patent: Sep. 15, 2026

(54) OUTDOOR UNIT OF AIR CONDITIONER

(71) Applicant: LG ELECTRONICS INC., Seoul (KR)

(72) Inventor: Min Ahn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 86 days.

(21) Appl. No.: 18/782,594

(22) Filed: Jul. 24, 2024

(65) Prior Publication Data

US 2025/0334283 A1 Oct. 30, 2025

(30) Foreign Application Priority Data

Apr. 30, 2024 (KR) ..... 10-2024-0057615

(51) Int. Cl.
*F24F 1/56* (2011.01)

(52) U.S. Cl.
CPC ..... *F24F 1/56* (2013.01)

(58) Field of Classification Search
CPC ..... F04B 35/04; F04B 39/121; F25B 13/00; F25B 31/02; F24F 1/08; F24F 1/56; F24F 11/89; F24F 1/22
See application file for complete search history.

(56) References Cited

U.S. PATENT DOCUMENTS 11,480,184 B2 10/2022 Sugiyama et al.

FOREIGN PATENT DOCUMENTS

| | | | | |
|---|---|---|---|---|
| CN | 104638448 A | * | 5/2015 | ..... H01R 13/527 |
| JP | 2010-024940 | | 2/2010 | |
| JP | 2018021628 A | * | 2/2018 | ..... F16J 12/00 |
| JP | 7269829 | | 5/2023 | |
| KR | 20040042014 A | * | 5/2004 | |
| KR | 10-2412319 | | 6/2022 | |
| WO | WO 2015/067107 | | 5/2015 | |

OTHER PUBLICATIONS

European Search Report issued in Application No. 24208392.1 dated Apr. 3, 2025.

* cited by examiner

*Primary Examiner* — Frantz F Jules
*Assistant Examiner* — Martha Tadesse
(74) *Attorney, Agent, or Firm* — KED & ASSOCIATES

(57) ABSTRACT

An outdoor unit of an air conditioner may include a compressor with a power terminal that protrudes from an upper surface thereof, and a terminal cover assembly coupled to the upper surface of the compressor to cover the power terminal. The terminal cover assembly may include a gasket disposed on the upper surface of the compressor; a terminal cover coupled to an upper surface of the gasket; and one or more fastening members that secures the gasket and the terminal cover to the compressor. The terminal cover may be formed of a metal material.

4 Claims, 11 Drawing Sheets

OUTDOOR UNIT OF AIR CONDITIONER

CROSS-REFERENCE TO RELATED APPLICATION(S)

This application claims the benefits of priority to Korean Patent Application No. 10-2024-0057615, filed in Korea on Apr. 30, 2024, the contents of which its incorporated herein by reference in its entirety.

BACKGROUND

1. Field

An outdoor unit of an air conditioner is disclosed herein.

2. Background

An air conditioner is an apparatus that heats or cools an indoor space using a refrigerant, and includes a refrigerant circulation system comprising a compressor, a condenser, an expansion valve, and an evaporator. High-temperature and high-pressure refrigerant discharged from the compressor and a fluid, such as water, circulating along an indoor hot fluid pipe exchange heat in a heat exchange device defined as a heat storage tank, to supply hot fluid, such as water, to the indoor space. Such a heat storage type air conditioner may be defined as an Air to Water Heat Pump (AWHP).

The AWHP is a device in which the refrigerant absorbs heat from the air through the evaporator, is converted into the high-temperature and high-pressure refrigerant while passing through the compressor, and then releases the heat back into the fluid flowing into the heat storage tank. In other words, the heat storage type air conditioner may be understood as a device that receives heat from air and supplies the supplied heat and the energy (compression work) supplied from the compressor to the fluid in the form of thermal energy.

The AWHP may be divided into an indoor unit and an outdoor unit. The indoor unit may accommodate a fan and a heat exchanger. The outdoor unit may accommodate a fan, a heat exchanger, a compressor, and a heat storage tank.

A motor may be installed inside of the compressor installed in the outdoor unit of the air conditioner, and a power terminal may be provided on an upper surface to supply power to the motor. Additionally, as there is a risk of fire if refrigerant leaks from the compressor and sparks occur at the power terminal, the power terminal may be covered with a terminal cover.

As conventional terminal covers are made of plastic injection molding, they have the disadvantage of being vulnerable to fire. In particular, air conditioners using R290 refrigerant have a higher risk of explosion compared to air conditioners using other refrigerants, so high levels of waterproofing/dustproofing/fireproofing are required for the safety of flammable refrigerants.

BRIEF DESCRIPTION OF THE DRAWINGS

Embodiments will be described in detail with reference to the following drawings in which like reference numerals refer to like elements, and wherein.

DETAILED DESCRIPTION

Figure 1:
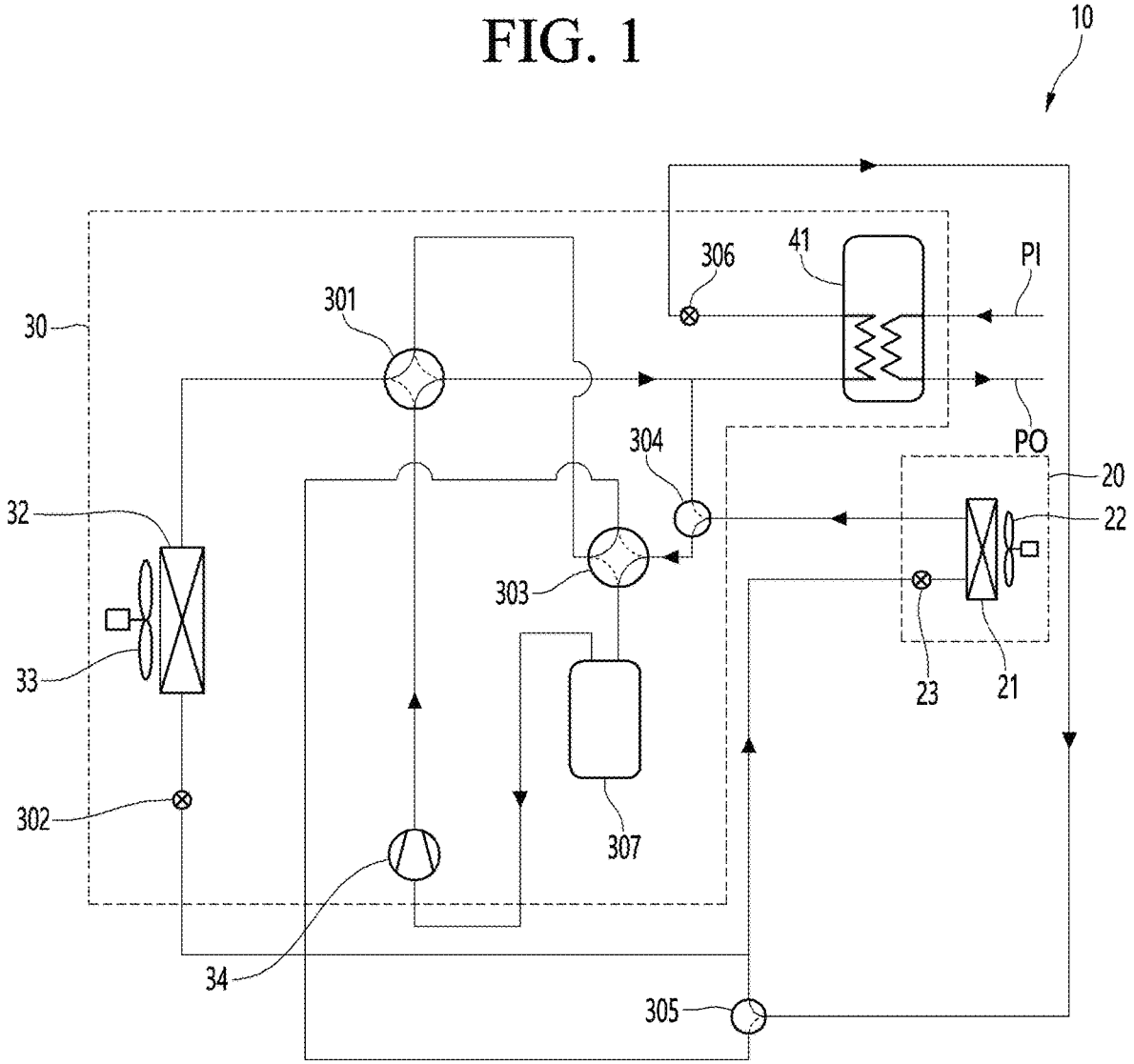
FIG. 1 is a schematic diagram of a heat storage type air conditioner according to an embodiment, showing a flow of refrigerant in a cooling hot fluid mode.

FIG. 1 is a schematic diagram of a heat storage type air conditioner according to an embodiment, showing a flow of refrigerant in cooling hot fluid mode. Referring to FIG. 1, a heat storage type air conditioner 10 or an air conditioning system according to an embodiment may include an outdoor unit 30, an indoor unit 20, and a heat storage tank 41.

A compressor 34, a first four-way side 301 connected to an outlet of the compressor 34, the heat storage tank 41, an accumulator 307 connected to an inlet side of the compressor 34, an outdoor heat exchanger 32, an outdoor fan 33, an outdoor expansion valve 302, a second four-way valve 303, a first three-way valve 304, a second three-way valve 305, and a hot fluid valve 306 connected to an outlet side of the heat storage tank 41 may be accommodated inside of the outdoor unit 30. Additionally, an indoor heat exchanger 21, an indoor fan 22, and an indoor expansion valve 23 may be accommodated inside of the indoor unit 20.

An inlet pipe (PI) may be connected to one or a first side of the heat storage tank 41, and an outlet pipe (PO) may be connected to the other or a second side of the heat storage tank 41. In addition, the components above form a closed circuit by a refrigerant pipe, and depending on an operation mode, an opening degrees of the first four-way valve 301, the second four-way valve 303, the first three-way valve 304, and the second three-way valve 305 may be varied to change a flow of refrigerant. More specifically, the flow of refrigerant in the cooling hot fluid mode will be described hereinafter.

When the cooling hot fluid mode is selected, high-temperature and high-pressure gaseous refrigerant discharged from the compressor 34 flows into the heat storage tank 41 while passing through the first four-way valve 301. The refrigerant passing through the heat storage tank 41 exchanges heat with a fluid, such as water, flowing into the heat storage tank 41 through the inlet pipe (PI) and then passes through the hot fluid valve 306. The fluid flowing into the heat storage tank 41 along the inlet pipe (PI) absorbs heat from the gaseous refrigerant, increases its temperature, and then flows into the indoors through the outlet pipe (PO). The hot fluid valve 306 is opened when the cooling hot fluid mode is selected, such that the high-temperature and high-pressure gaseous refrigerant discharged from the compressor 34 may pass through the heat storage tank 41.

The refrigerant discharged from the compressor 34 changes phase into a high-temperature liquid refrigerant while passing through the heat storage tank 41, and after passing through the hot fluid valve 306, a flow direction is changed by the second three-way valve 305 to be guided to the indoor unit 20. The refrigerant flowing into the indoor unit 20 expands into a low-temperature and low-pressure two-phase refrigerant while passing through the indoor expansion valve 23, and then changes into a low-temperature and low-pressure gaseous refrigerant while passing through the indoor heat exchanger 21.

The refrigerant that has passed through the indoor heat exchanger 21 changes its flow direction while passing through the first three-way valve 304 and is guided to the second four-way valve 303. The refrigerant guided to the second four-way valve 303 passes through the accumulator 307 and then returns to the compressor 34.

Figure 2:
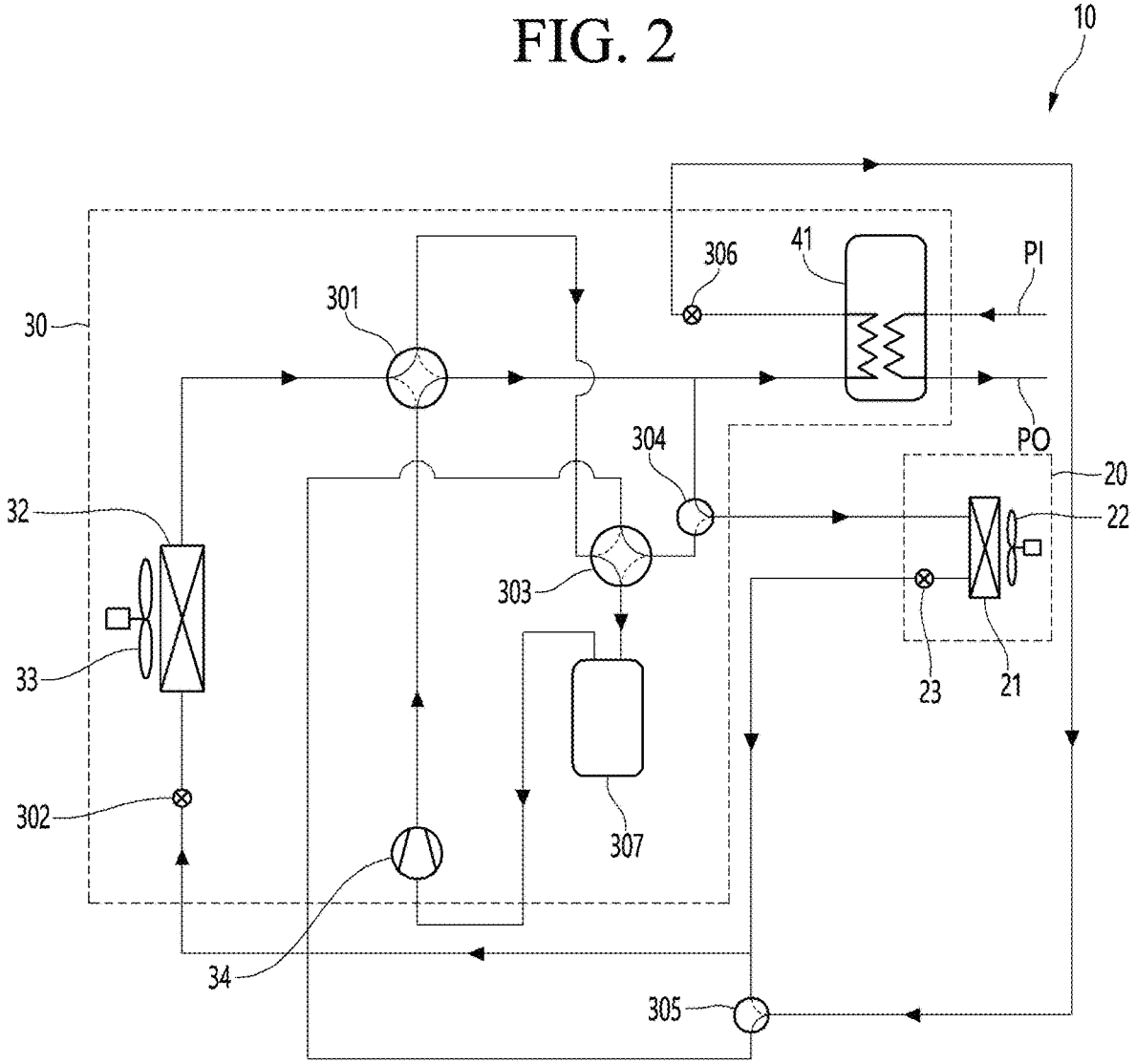
FIG. 2 is a schematic diagram of a heat storage type air conditioner according to an embodiment showing a flow of refrigerant in a heating hot fluid mode.

FIG. 2 is a schematic diagram of a heat storage type air conditioner according to an embodiment showing a flow of refrigerant in a heating hot fluid mode. Referring to FIG. 2, when the heating hot fluid mode is selected, a flow direction of the high-temperature and high-pressure gaseous refrigerant discharged from the compressor 34 is changed by the first four-way valve 301 and is guided to the heat storage tank 41. Some of the refrigerant guided to the heat storage tank 41 is branched into the first three-way valve 304.

The refrigerant guided to the heat storage tank 41 passes through the heat storage tank 41 as the hot fluid valve 306 is opened and exchanges heat with the fluid flowing into the heat storage tank 41 through the intake pipe (PI). The refrigerant passing through the heat storage tank 41 changes phase into a high-temperature and high-pressure liquid refrigerant, and the fluid flowing into the inlet pipe (PI) is heated and supplied indoors through the outlet pipe (PO).

The liquid refrigerant passing through the heat storage tank 41 has its flow direction changed by the second three-way valve 305 and is guided to the outdoor expansion valve 302. The refrigerant guided to the outdoor expansion valve 302 passes through the outdoor expansion valve 302 and expands into a low-temperature and low-pressure two-phase refrigerant and then flows into the outdoor heat exchanger 32.

The refrigerant flowing into the outdoor heat exchanger 32 is vaporized into a low-temperature and low-pressure gaseous refrigerant while passing through the outdoor heat exchanger 32, and then the flow direction is changed by the first four-way valve 301 to flow into the second four-way valve 303. In addition, the refrigerant passing through the second four-way valve 33 flows into the accumulator 307, and only the gaseous refrigerant flows into the compressor 34.

A portion of the high-temperature and high-pressure gaseous refrigerant branched at a point between the first four-way valve 301 and the heat storage tank 41 has its flow direction changed by the second four-way valve 303 and flows into the indoor unit 20. The refrigerant flowing into the indoor heat exchanger 21 of the indoor unit 20 is condensed and changes phase into a low-temperature and low-pressure liquid refrigerant, and then passes through the indoor expansion valve 23, to combine with the refrigerant passing through the second three-way valve 305 after passing through the hot fluid valve 306, and finally flows into the outdoor unit 30.

The refrigerant flowing into the outdoor unit 30 expands into a low-temperature and low-pressure two-phase refrigerant while passing through the outdoor expansion valve 302, and evaporates into a low-temperature gaseous refrigerant while passing through the outdoor heat exchanger 32. In addition, the refrigerant passing through the outdoor heat exchanger 32 has its flow direction changed by the first four-way valve 301 and the second four-way valve 303, and flows into the accumulator 307, and only the gaseous refrigerant is reintroduced to the compressor 34.

Figure 3:
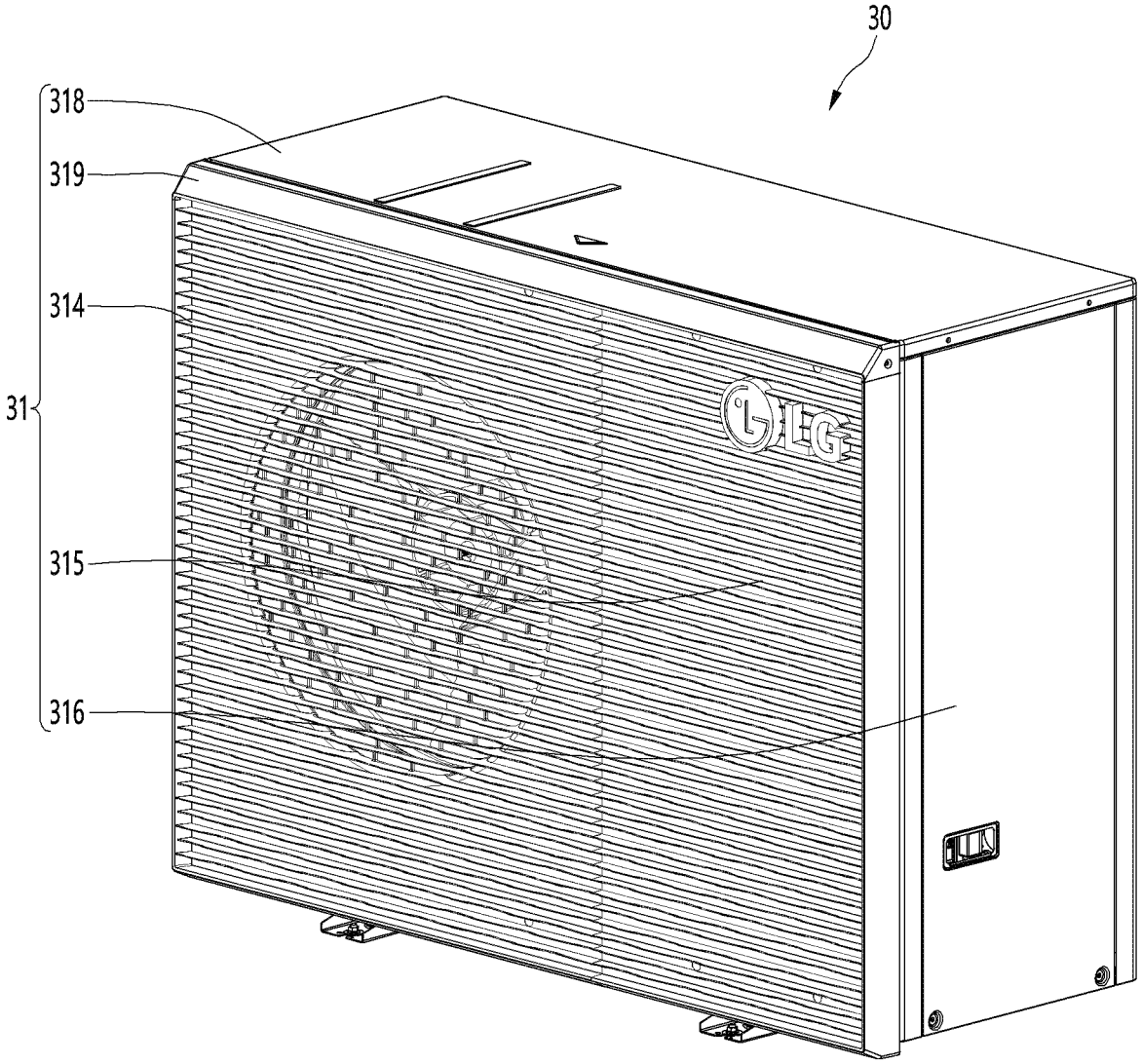
FIG. 3 is a front perspective view of an outdoor unit of a heat storage type air conditioner according to an embodiment.
Figure 4:
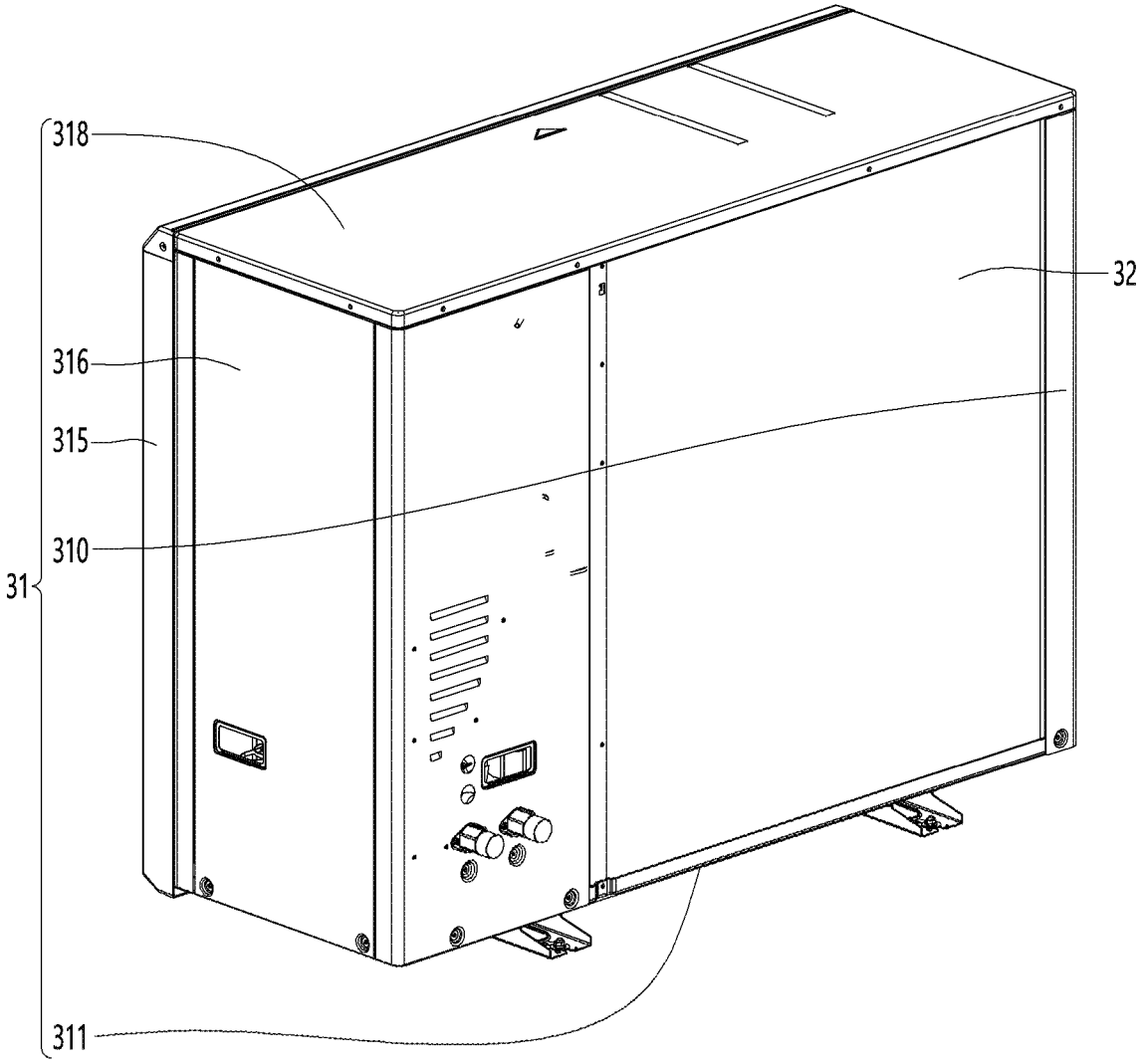
FIG. 4 is a rear perspective view of the outdoor unit of FIG. 3.
Figure 5:
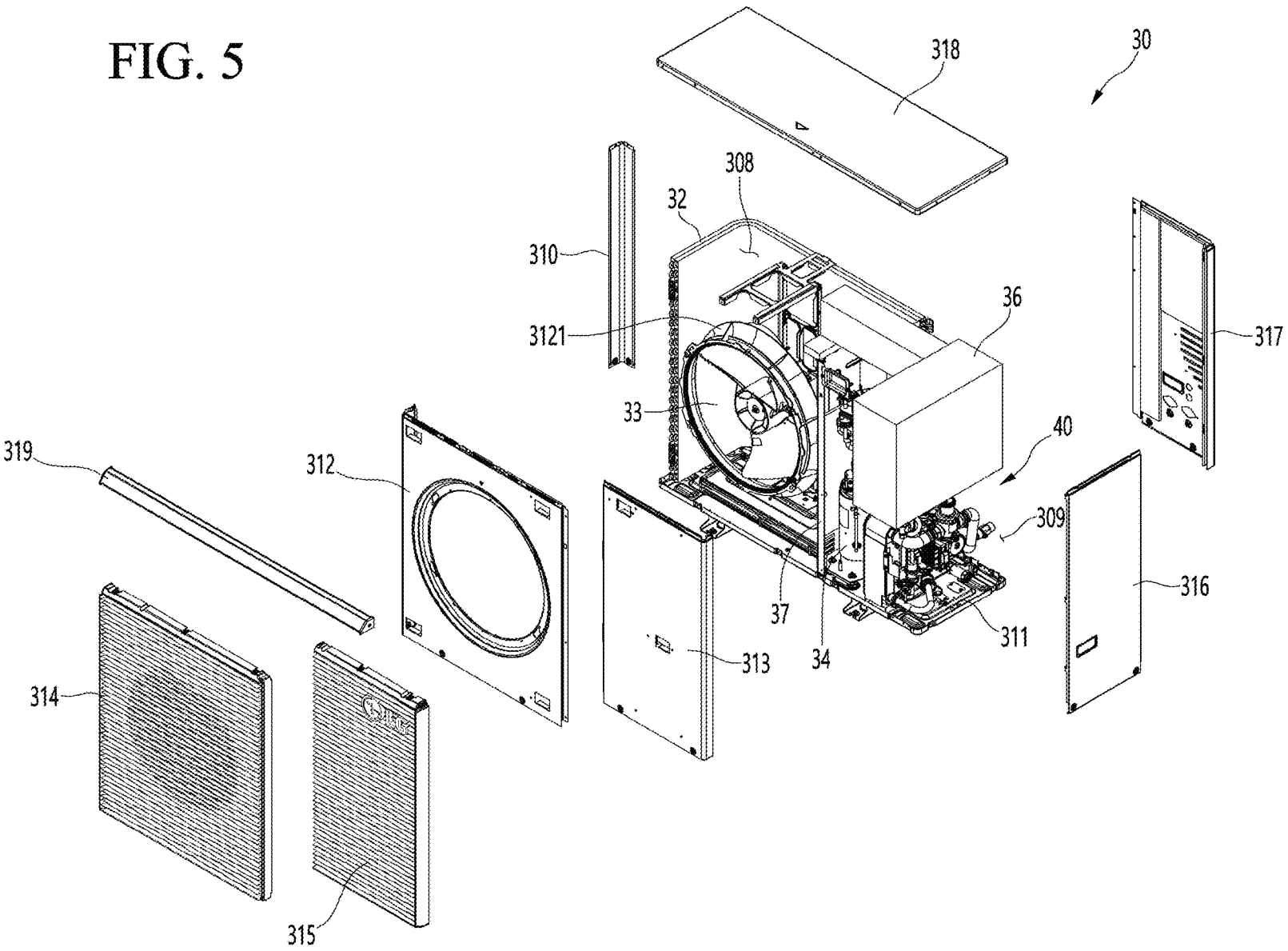
FIG. 5 is an exploded perspective view of the outdoor unit of FIG. 3.

FIG. 3 is a front perspective view of an outdoor unit of a heat storage type air conditioner according to an embodiment. FIG. 4 is a rear perspective view of the outdoor unit of FIG. 3. FIG. 5 is an exploded perspective view of the outdoor unit of FIG. 3.

Referring to FIGS. 3 to 5, the outdoor unit 30 of a heat storage air conditioner according to an embodiment may include a case 31 forming an outer appearance, compressor 34 accommodated inside of the case 31, outdoor heat exchanger 32, outdoor fan 33, a control box 36, and a heat storage unit 40. An internal space of the case 31 may be divided into a heat exchange room 308 and a component room 309 by a partition wall 37. The outdoor heat exchanger 32 and the outdoor fan 33 may be accommodated in the heat exchange room 308, and the component room 309 may contain components excluding the outdoor heat exchanger 32 and the outdoor fan 33, that is, the compressor 34, the control box 35, and the heat storage unit 40.

The case 31 may include an edge supporter 310, a base plate 311, a front panel, a grille member, a side panel 316, a rear panel 317, a top cover 318, and an upper panel 319. The base plate 311 may form a bottom of the outdoor unit 30 and may have a rectangular parallelepiped shape.

The outdoor heat exchanger 31 may be bent into a L shape to define one side end and a portion of a rear end of the base plate 311, more specifically, a side and rear surface of the heat exchange chamber 308.

The front panel may include a first front panel 312 that covers a front of the heat exchange chamber 308 and a second front panel 313 that covers a front of the component room 309. A circular outlet may be formed in the first front panel 312, and a shroud 3121 may be mounted on a backside of the outlet. Air introduced into the heat exchange chamber 308 by the outdoor fan 33 may be discharged to an outside through a discharge port.

The grille member may include a discharge grille 314 that covers a front of the first front panel 312 and a cover grille 315 that covers a front of the second front panel 313. The discharge grille 314 may be formed with the discharge port coaxial with a discharge port of the first front panel 312. The discharge grille 314 and the cover grille 315 may function to shield the first and second front panels 312 and 313 from being exposed to the outside.

The side panel 316 may cover the side of the component room 309. The rear panel 317 may cover a rear of the component room 309.

The top cover 318 may be coupled to an upper end of the grille member 315 and be in close contact with a front end of the top cover 318. The edge supporter 310 may be disposed at a bent corner of the outdoor heat exchanger 32 to connect a rear edge of the base plate 311 and a rear edge of the top cover 318.

Figure 6:
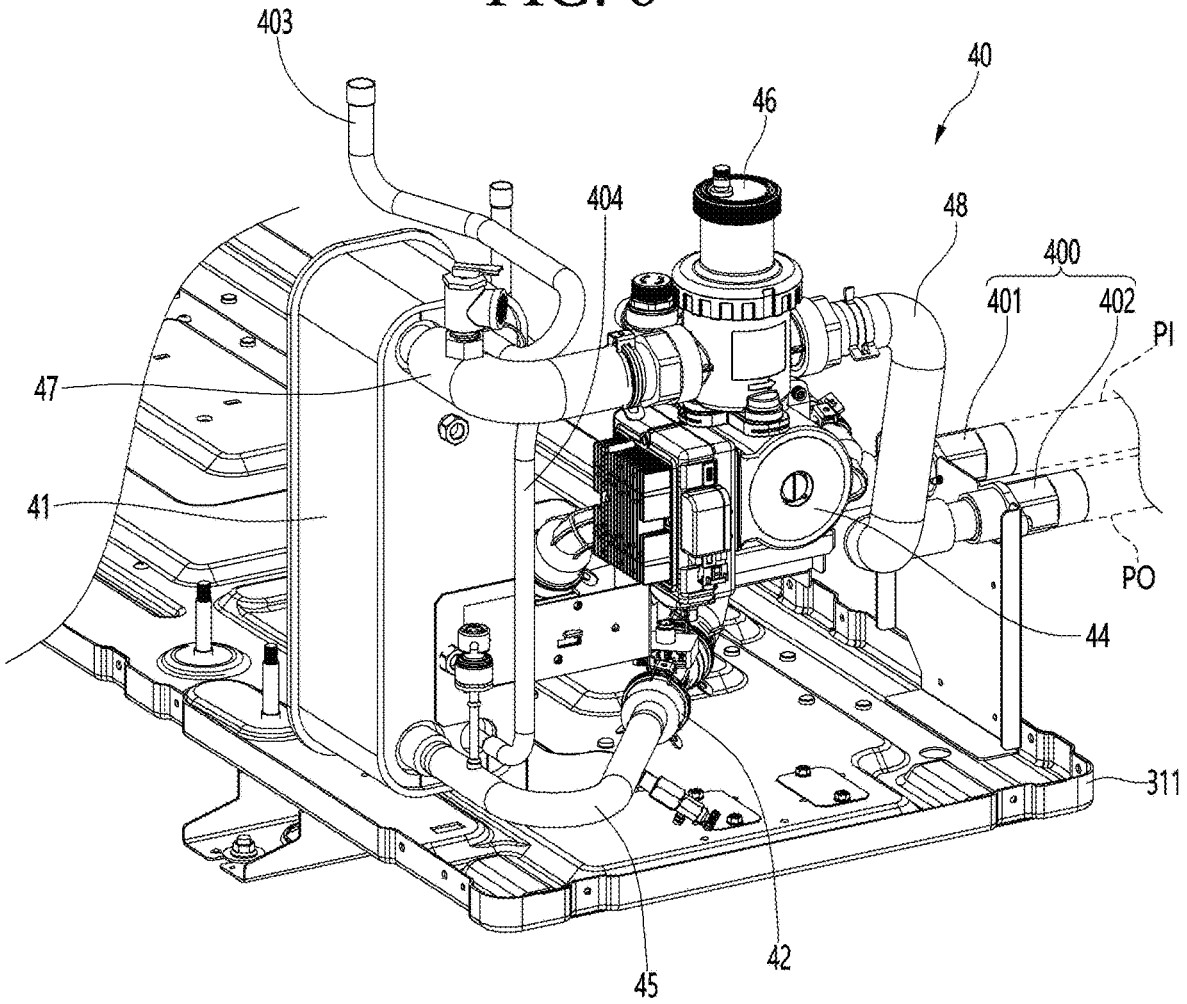
FIG. 6 is a side perspective view of a heat storage unit provided in the outdoor unit of a heat storage type air conditioner according to an embodiment.
Figure 7:
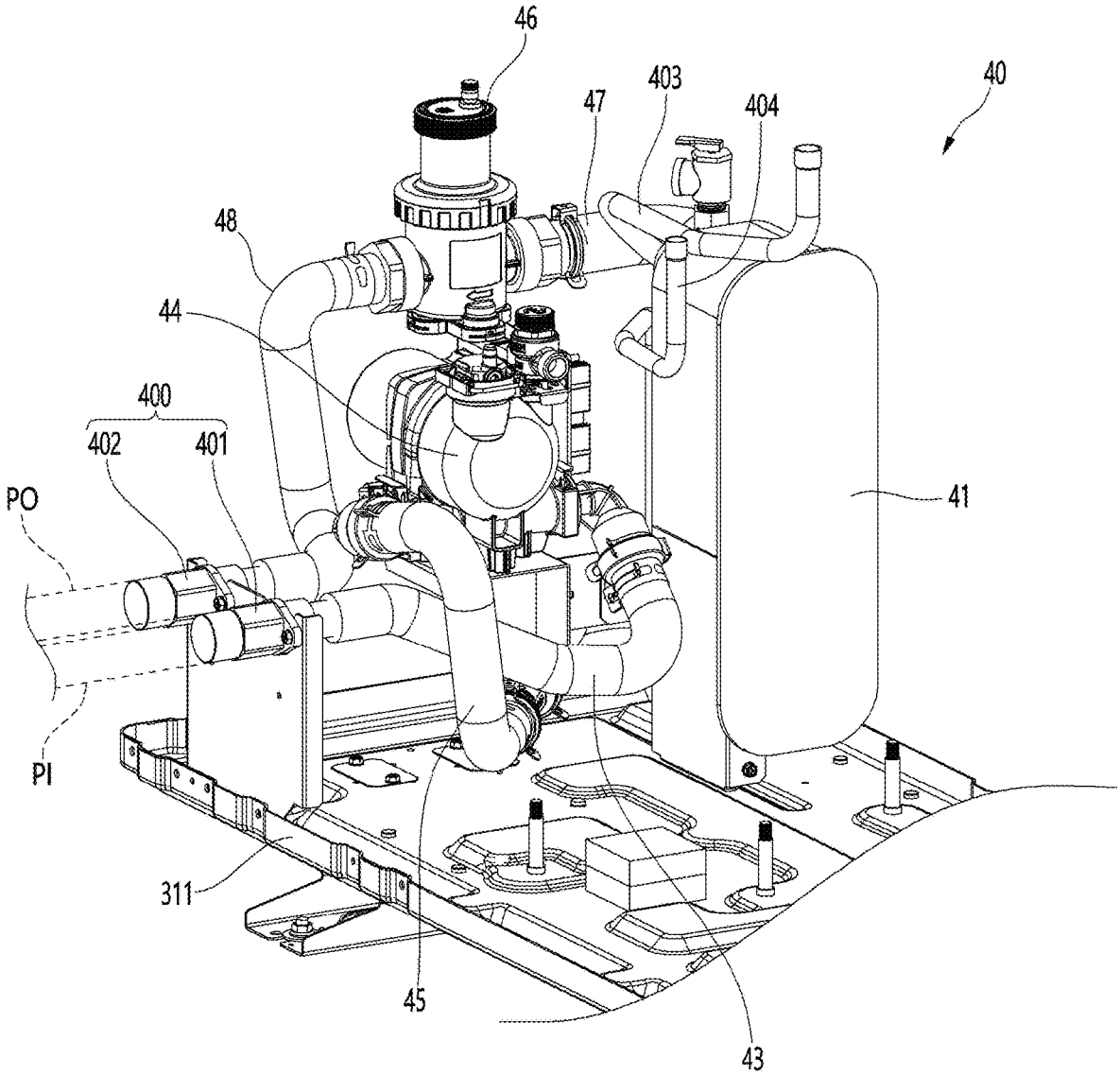
FIG. 7 is a rear perspective view of the heat storage unit of FIG. 6.

FIG. 6 is a side perspective view of a heat storage unit provided in the outdoor unit of a heat storage type air conditioner according to an embodiment. FIG. 7 is a rear perspective view of the heat storage unit of FIG. 6.

Referring to FIGS. 6 and 7, heat storage unit 40 may be installed inside of the outdoor unit 30 of the heat storage type air conditioner according to an embodiment. The heat storage unit 40 may be disposed in the component room 309 of the outdoor unit 30 and near the compressor 34.

The heat storage unit 40 may include heat storage tank 41. The heat storage tank 41 may be defined as a device in which high-temperature and high-pressure gaseous refrigerant passing through the compressor 34 exchanges heat with a fluid, such as water, for heating or hot fluid supplying (hot water supplying).

A refrigerant inlet pipe 403 may be connected to one or a first side of the heat storage tank 41, and a refrigerant discharge pipe 404 may be connected to the other or a second side. For example, the refrigerant inlet pipe 403 may be connected to an upper side of the heat storage tank 41, and the refrigerant discharge pipe 404 may be connected to a lower side of the heat storage tank 41. It can be understood that the refrigerant inlet pipe 403 is a refrigerant pipe that connects the first four-way valve 301 and the heat storage tank 41, and the refrigerant discharge pipe 404 is a refrigerant pipe that connects the heat storage tank 41 and the hot fluid valve 306.

The heat storage unit 40 may include a pump inlet pipe 43, a pump 44, a pump discharge pipe 45, a deaerator 46, a deaeration inlet pipe 47, a deaeration discharge pipe 48, and a flow sensor 42. A connector 400 may be mounted on a rear of the outdoor unit 30, and the connector 400 may include an inlet connector 401 and an outlet connector 402. In addition, the intake pipe (PI) may be connected to one end of the inlet connector 401, and the outlet pipe (PO) may be connected to one or a first end of the outlet connector 402. Additionally, one or a first end of the pump inlet pipe 43 may be connected to the other or a second end of the inlet connector 401, and one or a first end of the deaeration discharge pipe 48 may be connected to the other or a second end of the outlet connector 402. The other or a second end of the pump inlet pipe 43 may be connected to a suction port of the pump 44, and the other or a second end of the deaeration discharge pipe 48 may be connected to a discharge port of the deaerator 46.

In addition, one or a first end of the pump discharge pipe 45 may be connected to a discharge port of the pump 44, and the other or a second end of the pump discharge pipe 45 may be connected to the heat storage tank 41. The deaeration inlet pipe 47 may connect the heat storage tank 41 and a suction port of the deaerator 46. For example, the deaeration inlet pipe 47 may be connected to an upper side of the heat storage tank 41, and the pump discharge pipe 45 may be connected to a lower side of the heat storage tank 41. The refrigerant and fluid may flow in opposite directions inside of the heat storage tank 41, thereby increasing an amount of heat exchange per unit time. That is, heat exchange efficiency may be improved.

With this configuration, when the high-temperature and high-pressure gaseous refrigerant flows into the heat storage tank 41 through the refrigerant inlet pipe 403 and flows downward and is discharged through the refrigerant discharge pipe 404, the fluid flowing into the inlet pipe (PI) may be introduced into the heat storage tank 41 through the pump inlet pipe 43, the pump 44, and the pump discharge pipe 45. In addition, the hot fluid heated by heat exchange with the refrigerant while flowing upward inside of the heat storage tank 41 may be supplied to the indoor space through the deaeration inlet pipe 47, the deaerator 46, the deaeration discharge pipe 48, and the outlet pipe (PO). The hot fluid, such as water, supplied to the indoors is used for hot fluid supply (hot water supply) or indoor floor heating.

In addition, the flow sensor 42 may be installed at one point of the pump discharge pipe 45, so that a flow rate of fluid flowing into the heat storage tank 41 may be measured. In addition, gas contained in the fluid passing through the heat storage tank 41 may be discharged to the outside from the deaerator 46, and only the degassed hot fluid may be supplied indoors through the deaeration discharge pipe 48 and the outlet pipe (PO).

Figure 8:
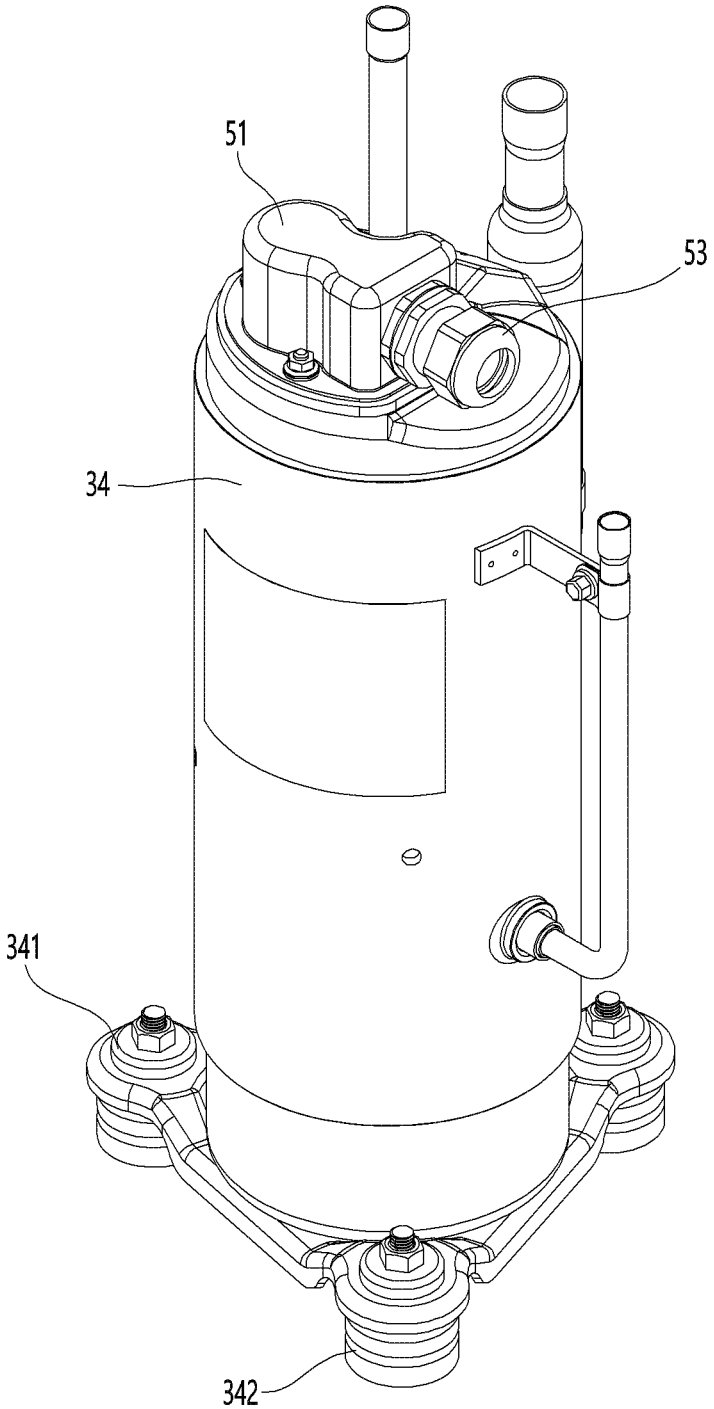
FIG. 8 is a perspective view of a compressor equipped with a terminal cover assembly according to an embodiment.
Figure 9:
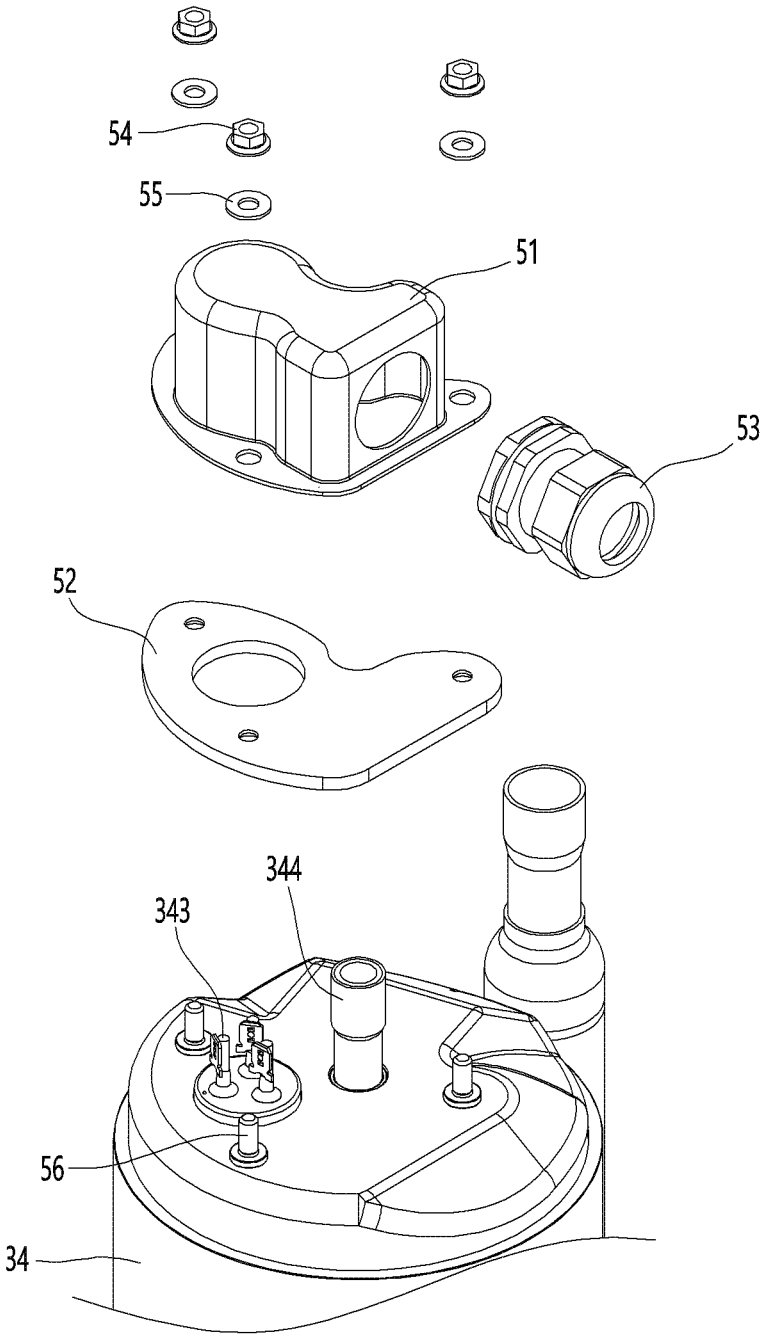
FIG. 9 is an exploded perspective view of the terminal cover assembly and the compressor.

FIG. 8 is a perspective view of a compressor equipped with a terminal cover assembly according to an embodiment. FIG. 9 is an exploded perspective view of the terminal cover assembly and the compressor.

Referring to FIGS. 8 and 9, the terminal cover assembly according to an embodiment may include a terminal cover 51 that covers a power terminal 343 exposed on an upper surface of the compressor 34, a gasket 52 coupled to a lower end of the terminal cover 51, and a cable gland 53 coupled to one side of the terminal cover 51. The terminal cover 51 and the gasket 52 may be coupled to one body by a plurality of screws 56 that protrudes by passing through the upper surface of the compressor 34, nuts 54 and washers 55 which are respectively coupled to the plurality of screws 56. The plurality of screws 56 may penetrate each of the gasket 52 and the terminal cover 51, for example, at three points; however, embodiments are not limited thereto.

A discharge port 344 may extend from a center of the upper surface of the compressor 34, and the power terminal 343 may be mounted at a point spaced apart from the discharge port 344. Additionally, the terminal cover 51 may have a rounded shape so as not to interfere with the discharge port 344.

Figure 10:
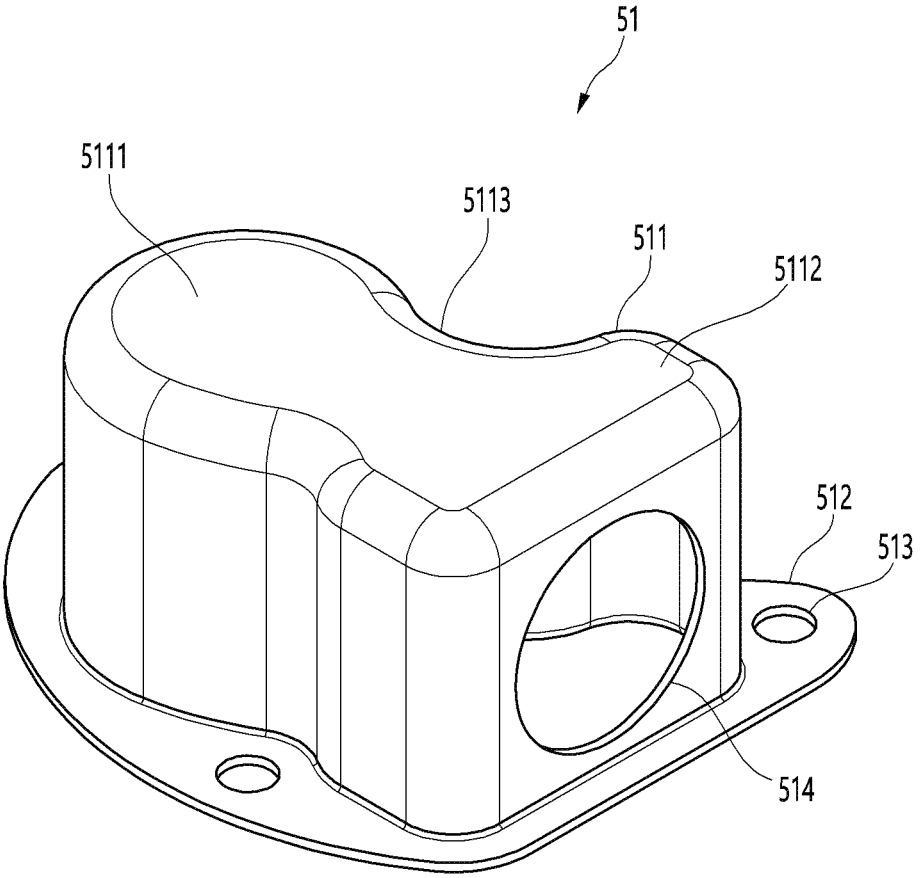
FIG. 10 is a perspective view of a terminal cover of a terminal cover assembly according to an embodiment.

FIG. 10 is a perspective view of a terminal cover of a terminal cover assembly according to an embodiment. Referring to FIG. 10, the terminal cover 51 of the terminal cover assembly according to an embodiment may be made of a metal material and may be recessed to a predetermined depth through a forming process.

The terminal cover 51 may include a cover body 511 that forms an accommodation space in which the power terminal 343 and a cable (not shown) introduced through the cable gland 53 are received, and a cover flange 512 bent and extending from the edge of the body 511. The cover flange 512 is a part or portion configured to be seated on an upper surface of the gasket 51, and a plurality of fastening holes 513 may be formed in the cover flange 512.

The accommodation space formed inside of the cover body 511 may include a terminal accommodation portion 5111 and a cable accommodation portion 5112.

Additionally, a discharge port avoidance portion 5113 may be formed at a boundary between the terminal accommodating portion 5111 and the cable accommodating portion 5112. The discharge port avoidance portion 5113 may be understood as a part or portion formed in such a manner that a part or portion of a side surface of the cover body 511 is concavely rounded toward a center of the cover body 511 to avoid interference with the discharge port 344.

Additionally, the terminal receiving portion 511 may have, for example, a circular cross-sectional shape so as to surround the power terminal 343. In addition, a gland hole 514 for coupling the cable gland 53 may be formed on one side surface of the cover body 511 that defines the cable receiving portion 5112. The cable gland 53 may be made of stainless steel, for example, and have a hollow cylindrical shape, so that cables may pass through the cable gland 53, and enter the cover body 511 to be connected to the power terminal 343.

As the terminal cover 51 is made of a metal material, a possibility of explosion of refrigerant leaking inside of the outdoor unit 30 due to a spark occurring in the power terminal 343 may be minimized. In addition, even if a fire occurs inside of the power terminal 343, the flame may be prevented from spreading outside the terminal cover 51.

Figure 11:
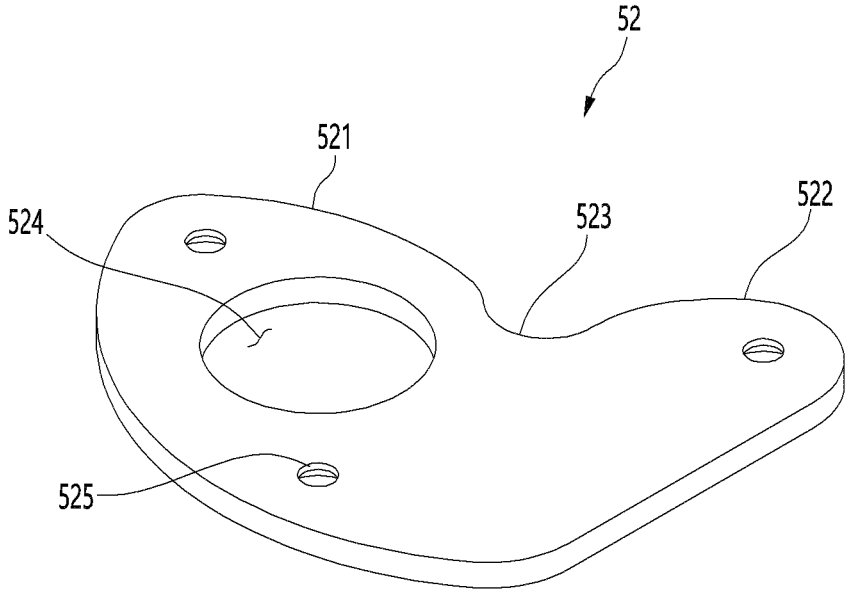
FIG. 11 is a perspective view of a gasket of a terminal cover assembly according to an embodiment.

FIG. 11 is a perspective view of a gasket of a terminal cover assembly according to an embodiment. Referring to FIG. 11, a lower surface of the terminal cover 51 may be open, and the gasket 52 may shield the lower surface of the terminal cover 51.

The gasket 52 may include a terminal receiving part or portion 521 that covers the lower end of the terminal accommodation portion 5111 formed on the terminal cover 51; and a cable receiving part or portion 522 that covers a lower end of the cable accommodation portion 5112. In addition, a concave round discharge port avoidance portion 523 may be formed at a boundary between the terminal receiving portion 521 and the cable receiving portion 522.

The gasket 52 may be seated on the upper surface of the compressor 34, and a plurality of fastening holes 525 may be formed at edge thereof. A plurality of screws 56 that protrudes by passing through the upper surface of the compressor 34 from an inside of the compressor 34 may penetrate the plurality of fastening holes 525 formed in the edge of the gasket 52 and pass through the plurality of fastening holes 513 formed in the cover flange 512 of the cover body 511. Then, the washer 55 and the nut 54 may be sequentially inserted into an outer peripheral surface of the screw 56, so that the cover flange 512 and the gasket 52 may be strongly in contact with each other.

Additionally, a terminal through-hole 524 may be formed inside of the gasket 52, so that the power terminal 343 may penetrate the gasket 52 and be accommodated in the terminal accommodation portion 5111. The terminal through-hole 524 may be formed in the terminal receiving portion 521.

The gasket 52 may have a same contour as that of the cover flange 512, so that the discharge port avoidance portion 523 may be formed on one side thereof.

An outdoor unit of an air conditioner according to embodiments disclosed herein may include a compressor with a power terminal that protrudes from an upper surface thereof, and a terminal cover assembly coupled to the upper surface of the compressor to cover the power terminal. The terminal cover assembly may include a gasket disposed on the upper surface of the compressor; a terminal cover coupled to an upper surface of the gasket; and one or more fastening members that secure the gasket and the terminal cover to the compressor. The terminal cover may be formed of a metal material.

The terminal cover may include a cover body that forms a terminal accommodation portion and a cable accommodating portion therein, and a cover flange that is outwardly bent from a lower end of the cover body to be seated on the gasket. A discharge port may extend from the upper surface of the compressor, and an avoidance portion that avoids interference with the discharge port may be recessed on one side surface of the cover body.

The outdoor unit according to the embodiments disclosed herein may further include a cable gland coupled to the one side surface of the cover body. A gland hole to which the cable gland may be coupled is formed on one side surface of the cover body defining the cable accommodating portion.

One or more fastening holes through which the one or more fastening member may pass may be are formed at edges of the cover flange and the gasket.

A terminal through hole through which the power terminal may pass may be formed in an inner side the gasket.

According to embodiments disclosed herein, even if a highly flammable refrigerant such as R290 refrigerant, is used, the risk of explosion due to refrigerant leakage becomes lower, because a terminal cover made of a metal may be provided. In addition, by connecting a cable gland to one side surface of the terminal cover and allowing the cable connected to the power terminal to pass through the cable gland, there is an advantage in that it is possible to implement a sealed terminal cover structure, thereby minimizing the risk of fire.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor unit of an air conditioner, comprising:

a compressor that compresses a flammable refrigerant;

a power terminal that protrudes from an upper surface thereof; and a terminal cover assembly coupled to the upper surface of the compressor to cover the power terminal, wherein the terminal cover assembly includes:

a gasket disposed on the upper surface of the compressor and having a terminal through-hole at an inner side thereof and a plurality of fastening holes at an edge thereof;

a terminal cover coupled to an upper surface of the gasket and formed of a metal material; and a plurality of fastening members that protrudes outwardly by passing through the upper surface of the compressor to secure the gasket and the terminal cover to the compressor, wherein the terminal cover includes:

a cover body that forms a terminal accommodating portion and a cable accommodating portion therein; and a cover flange that is outwardly bent from a lower end of the cover body to be seated on the gasket and includes a plurality of fastening holes, wherein the plurality of fastening members is configured to sequentially pass through the plurality of fastening holes of the gasket and the plurality of fastening holes of the cover flange, and wherein a washer and a nut are sequentially inserted onto an outer peripheral surface of each of the plurality of fastening members, such that the cover flange and the gasket are in contact with each other to implement a sealed terminal cover structure, thereby minimizing a risk of fire.

2. The outdoor unit according to claim 1, wherein a discharge port extends from the upper surface of the compressor, and wherein an avoidance portion that avoids interference with the discharge port is recessed on one side surface of the cover body.

3. The outdoor unit according to claim 1, further comprising a cable gland coupled to the one side surface of the cover body.

4. The outdoor unit according to claim 1, wherein a gland hole to which the cable gland is coupled is formed on one side surface of the cover body defining the cable accommodating portion.

* * * * *